United States Patent [19]

Agostino

[11] 4,290,162

[45] Sep. 22, 1981

[54] LIGHT-WEIGHT FLOOR-STANDING DRAIN CLEANER

[76] Inventor: Michael Agostino, 2558 Yates Ave., Bronx, N.Y. 10469

[21] Appl. No.: 139,985

[22] Filed: Apr. 14, 1980

Related U.S. Application Data

[63] Continuation-in-part of Ser. No. 56,298, Jul. 10, 1979, abandoned.

[51] Int. Cl.[3] ..... B08B 9/02
[52] U.S. Cl. ..... 15/104.3 SN
[58] Field of Search ..... 15/104.3 R, 104.3 SN

[56] References Cited

U.S. PATENT DOCUMENTS

| | | | |
|---|---|---|---|
| 2,424,413 | 7/1947 | Nelson | 15/104.3 SN |
| 3,162,878 | 12/1964 | Agostino | 15/104.3 SN |
| 3,298,051 | 1/1967 | Ratliff | 15/104.3 SN |
| 4,067,248 | 1/1978 | Lavagetto | 15/104.3 SN X |

*Primary Examiner*—Edward L. Roberts
*Attorney, Agent, or Firm*—Auslander, Thomas & Morrison

[57] ABSTRACT

Employing a relatively short cable in a drum with a closely spaced inner portion, an effective floor-standing drain cleaner is provided which is portable, usable in most simple situations, is light in weight and drivable by a removable electric hand drill.

7 Claims, 3 Drawing Figures

LIGHT-WEIGHT FLOOR-STANDING DRAIN CLEANER

The present invention is an improved light-weight floor-standing drain cleaner, a continuation in part of my patent application Ser. No. 56,298 entitled Household Drain Cleaning Machine, filed the 10th day of July, 1979 and now abandoned.

The present invention relates to a light-weight portable floor-standing drain cleaner, particularly usable by homeowners or professionals to meet the normal, simple clogged drain problems, usually encountered in the small pipes of a home or the pipes between the stories of a building. It solves the problem of providing a drain cleaner which is inexpensive, light-weight, floor-standing, drivable by a hand drill with cable, manipulatable with two hands, where clogs can be reached which are not more than two stories away.

Prior art drain cleaners have oftentimes been large and unwieldy because of their need to snake an assortment of distances in pipes of wide and narrow diameter. Such cleaners have been heavy, oftentimes requiring more than one person to operate and transport. Such drain cleaners have also been expensive because of the cost of long cable and the expense of the fixed motor needed to drive the cable for cleaning.

Smaller specialized drain cleaners have been provided, some even employing small attachable hand drills as their source of rotary power. Such drain cleaners of the past, such as disclosed in U.S. Pat. No. 3,609,788 to Mier, have achieved portability and some economy at the expense of providing a device that is bulky and hard to operate, in which the cable is not adequately protected against kicking, and in which the cable cannot easily be manipulated by the two hands of the user. Similar devices have oftentimes employed chucks to grasp and lock the snaking cable as it is extended from the drum. Such devices oftentimes cause kinking or snapping of the cable.

Lavagetto, in his U.S. Pat. No. 4,067,248, employs a complex hand-drill driven cable rotater, which must be hand held to operate and cannot be manipulated by one user with two hands.

Larger floor-standing drain cleaners such as in U.S. Pat. No. 3,605,158 to Russell may be portable and cable may be operable with two hands. Russell, though, requires a complex drum for its feed mechanism and a heavy fixed motor. Russell also, while concerned about kinking, depends upon the cable anchored to the drum to be restrained in the drum to protect against kinking.

Kinking has been an ever-present problem of the past. Kinking represents a danger also to the user as a consequence of breaking of the cable under stress, and danger to the user as the free end unwinds. The wearing out of an anchored cable under the stress of use is another problem, in addition to that of kinking. Further, kinking within a drum may inhibit effective cleaning as well as destroying the cable within the drum. Heavy-duty portable drain cleaners oftentimes have open drums which represent some danger of snapped or kinked cable flying out through the drum openings. The choice between open drums and closed drums is a difficult one. The closed drum is oftentimes difficult to get to, if kinked, and the open drum may pose a danger of kinking even though the cable may be accessible.

Criscuolo, in his U.S. Pat. No. 3,048,870, employs an open drum large-size sewer cleaner, which may have its cable operated by a single user using both hands. Criscuolo attempts to overcome the kinking problem by a slipping clutch arrangement between the motor and a drive on the drum.

The present inventor, in his U.S. Pat. No. 3,162,878, provided an open drum portable heavy-duty drain cleaning machine in which the cable could be operated by a single operator, using both hands. Slippage against kinking was provided for by the cable not being anchored to the drum.

According to the present invention, a light-weight portable floor-standing drain cleaner is operable by a single operator who may control the cable with both hands, the drain cleaner is safe in the event of kinking, but is constructed to avoid kinking and is operable by a separately attachable drive, such as a hand drill.

The present invention is particularly useful in a household environment. It is adapted to save the expense of having a fixed motor and thus is adapted to have a hand drill engaged to drive it. It is small in size, but large enough to hold a least twenty-five feet of cable of approximately one quarter inch diameter. The twenty-five feet is usually ample for reaching clogs as much as two stories away. The drive by the hand drill saves the expense of providing a one-purpose fixed motor. The particular construction makes the drain cleaner of the present invention an effective cleaning tool, even with the light power of the hand power drill. The drain cleaner of the present invention is ideal for household use because of its unique safety construction, which engages narrow cable between a small inner portion of a drum where the space between the inner portion of the drum and the outer portion of the drum is approximately three cable diameters. The cable is not anchored. The narrow spacing within the drum prevents normal slippage and kinking, yet allows for a strong drive on the cable, with easy two-hand manipulation.

The drum of the present invention is rounded, without openings other than the opening for the cable spindle. Usual cable for small use, such as household use, is between three sixteenth and three eighths of an inch. It has been found that maintaining a spacing between three and four diameters between the inner and outer portions of the drum provides adequate torque and satisfactory clutch-type slippage of the cable under stress.

A preferred cable is one quarter inch cable, which is normally effective in household situations. The narrow diameter of the cable and its relatively short length reduce the weight of the present invention without sacrificing of utility. Cable of twenty-five feet reaches two stories and is usually sufficient to reach most building clogs. Such limited length of cable also limits the entire weight of the drain cleaner of the present invention. Clogs further than twenty-five feet away can usually be reached from other stories, and usually do not require cable length in excess of twenty-five feet thereby. A safety cover protects the user from any danger from the rotation of the drum.

A preferred embodiment of the light-weight portable floor-standing drain cleaner is with a basic frame including a pair of spaced-apart members and a first and second pulley rotatably mounted on the frame with a drive belt. A free pulley shaft on the first pulley is engagable with a small electric hand drill which may be grasped by the frame members with its chuck engaged with the pulley shaft. The drum includes an inner portion and outer portion, closely spaced. The inner portion has a rounded top and the outer portion includes an opening in its top for an integral hollow spindle which is rotatably mounted at the spaced members. The drum is rotatably mounted on the second pulley. A cleaning cable is slidable through the spindle into the drum where it is coiled.

Although such novel feature or features believed to be characteristic of the invention are pointed out in the claims, the invention and the manner in which it may be carried out, may be further understood by reference to the description following and the accompanying drawings.

Referring now to the figures in greater detail, where like reference numbers denote like parts in the various figures.

Figure 1:
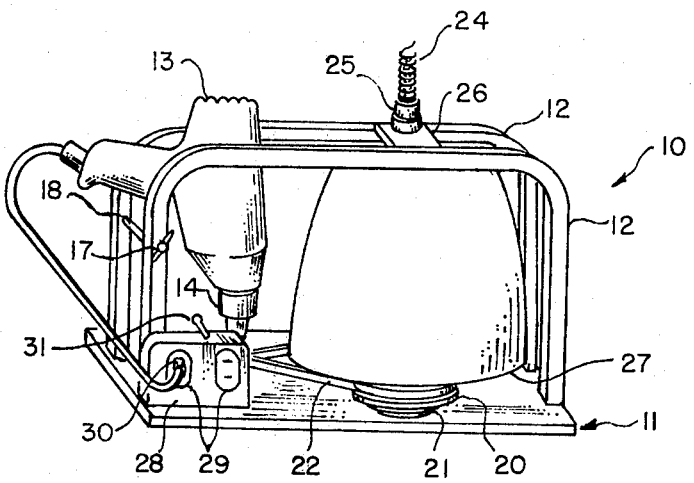
FIG. 1 is a front elevation isometric of the light-weight portable floor-standing drain cleaner of the present invention.
Figure 2:
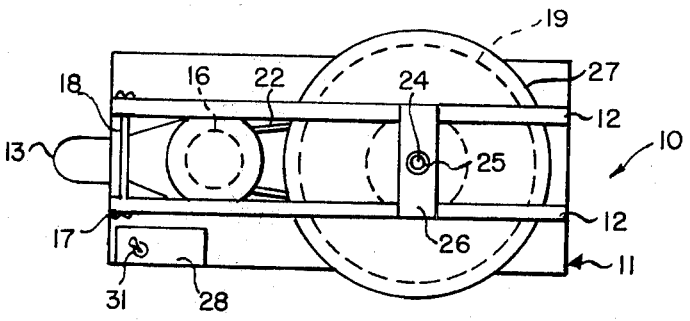
FIG. 2 is a top plan view of FIG. 1.

The portable drainer cleaner 10 comprises a frame 11 including a pair of generally U-shaped members 12 spanning the frame 11. An electric hand drill 13 has its chuck 14 engaged with a free pulley shaft 15 extending from the first small pulley 16, which is mounted on the frame 11. The drill 13 is held fixed in position between the U-shaped members 12 by a wing nut 17 on a bolt 18, which passes through the U-shaped members 12 and is tightenable to fastly hold the hand drill 13.

Figure 3:
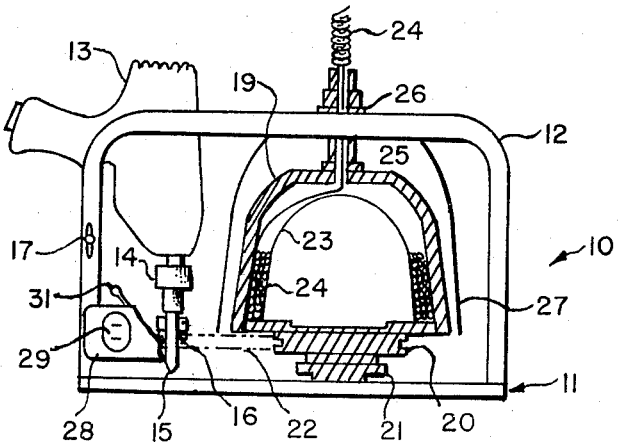
FIG. 3 is a cut-away front elevation of FIG. 1.

A drum 19, including a large pulley 20, is mounted on a rotatable bearing 21 which is fixed to the frame 11. The first pulley 16 and second pulley 20 are joined by a belt 22. The drum 19, as shown in FIG. 3, includes an inner portion 23. Within the drum 19 is the cable 24. The inner portion 23 is spaced apart from the outer portion of the drum 19, approximately three diameters of the cable 24. The cable 24 exits from within the drum 19 through a hollow spindle 25, extending from an opening in the drum 19. The spindle is rotatably mounted in a support 26 which is integrally joined with the two members 12. The support 26 spaces and holds the members 12 and stabilizes a spindle 25.

A protective cover 27 is affixed under the members 12 and covers the drum 19 so that it cannot endanger anyone while it is rotating.

In a preferred embodiment of the drain cleaner 10 of the present invention, a switch box 28 is mounted on frame 11. The switch box 28 has a plug (not shown) which can be plugged into an outlet and includes receptacles 29, which may receive the plug 30 from the hand drill 13. The receptacle 29 can also be controlled by an "ON-Off" toggle switch 31.

In use, the hand drill 13 has its chuck 14 locked onto the free pulley shaft 15. The hand drill 13 then is locked into position for operation by tightening the wing nut 17 on the bolt 18, which draws the members 12 tightly against the hand drill 13, holding it in position. The plug 30 of the hand drill 13 is placed in one of the receptacles 29 and the plug (not shown) on the line cord of the receptacle 29 is plugged in.

Most hand drills have trigger locks to lock them in rotate position; thus, with the hand drill 13 locked to rotate, the power for the drain cleaner 10 is controlled from toggle switch 31.

Once the drain cleaner 10 is operating, the cable 24 can be grasped and withdrawn from the drum 19. It is preferable to use gloves while handling the cable 24. The cable 24 is allowed to rotate as it withdrawn or it may be withdrawn before the motor has been turned on.

Once the power is on, the cable 24 is fed into the clogged pipe until it engages the obstruction. By maneuvering the rotatable cable 24 back and forth in the pipe, it generally can clear an obstruction. The cable 24, once engaged with an obstruction, continues to receive the rotation imparted from the rotating drum 19.

The cable 24 is preferably one quarter inch cable or close to that. Using cable of that diameter enables effective use of the drain cleaner 10 in normal household situations. Restricting the cable to about twenty-five feet meets substantially the major requirements that would be met in household or building situations. The cable length and diameter are of importance, since the portability of the drain cleaner of the present invention in part depends upon its weight.

Effective cable rotation and anti-kinking are controlled by the spacing between the drum 19 and its inner portion 23. The drum 19 and inner portion 23 are preferably substantially of the same round conical configuration, spaced apart approximately three cable diameters. The cable 24 is not anchored within the drum 19. The cable 24 receives its rotative thrust from the rotation of the drum 19, because the cable 24 tightly packs itself within the drum 19.

When the cable 24 is at an obstruction, it continues to rotate. The cable 24, tightly lain, within the drum 19, cannot kink. As rotation continues to build against an obstruction, the cable 24 and the drum may slip within the drum 19, which acts as a clutch, in effect. The rounded top of the inner portion 23 of the drum 19 in their narrowly spaced apart configuration, acts as a guide for directing the cable 24 back and forth through the spindle 25 and into coiled position within the drum 19.

The drain cleaner 10 rests on its frame 11 while in use, leaving both hands of the operator free to manipulate the cable 24. Turning off the power is conveniently effected by just reaching for the toggle switch 31, or even touching it with the foot.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A light-weight portable floor-standing drain cleaner comprising a frame, said frame including a pair of adjacent spaced apart members, a first pulley rotatably mounted on said frame, a second pulley rotatably mounted on said frame, a drive belt, said drive belt connected between said first and second pulley, said first pulley including a free pulley shaft, said members including means to removably fix a hand drill with its chuck engaged with said first pulley shaft, a hollow rounded drum, said drum including an inner portion and an outer portion, said inner and outer portions closely spaced, said inner portion having a rounded top, said outer portion including an opening at its top, said outer portion including an integral hollow spindle extending from said opening, said spindle rotatably mounted between said members, said drum rotatably mounted on said second pulley, and a cleaning cable, said cable slidable through said spindle and adapted to coil within said drum.

2. The invention of claim 1 wherein said inner and outer drum portion are spaced approximately three to four cable diameter from each other.

3. The invention of claim 1 or 2 including a protective cover surrounding said drum.

4. The invention of claim 1 or 2 having a cable no more than twenty-five feet long.

5. The invention of claims 1, 2 or 4 wherein said cable diameter is between three sixteenth and three eighths of an inch.

6. The invention of claims 1, 2 or 4 having a cable diameter of one quarter of an inch.

7. The invention of claim 1 or 2 wherein said means to fix said hand drill is a wing nut and bolt passing through said members.

* * * * *